US005529214A

United States Patent [19]

Lasonde et al.

[11] Patent Number: 5,529,214

[45] Date of Patent: Jun. 25, 1996

[54] INFUSION PUMP

[75] Inventors: Gregory J. Lasonde, Lake Bluff; Joy D. Knauf, Chicago, both of Ill.

[73] Assignee: Secure Medical Products, Inc., Mundelein, Ill.

[21] Appl. No.: 289,748

[22] Filed: Aug. 12, 1994

[51] Int. Cl.[6] ..... B65D 35/56

[52] U.S. Cl. ..... 222/105; 222/189.06; 222/212; 222/386.5; 604/132; 604/133

[58] Field of Search ..... 222/95, 105, 189.6, 222/206, 212, 386.5; 604/132, 133, 141, 153; 417/437

[56] References Cited

U.S. PATENT DOCUMENTS

| | | | |
|---|---|---|---|
| 3,677,444 | 8/1972 | Merrill | 222/135 |
| 3,796,356 | 3/1974 | Venus, Jr. | 222/212 |
| 3,961,725 | 6/1976 | Clark | 222/1 |
| 4,386,929 | 6/1983 | Peery et al. | 604/132 |
| 4,419,096 | 12/1983 | Leeper et al. | 604/132 |
| 4,769,008 | 9/1988 | Hessel | 604/132 |
| 4,915,693 | 4/1990 | Hessel | 604/132 |
| 4,953,753 | 9/1990 | Gortz | 222/105 |
| 5,080,652 | 1/1992 | Sancoff et al. | 604/132 |
| 5,120,315 | 6/1992 | Hessel | 604/132 |
| 5,263,940 | 11/1993 | Kriegel | 604/132 |
| 5,284,481 | 2/1994 | Soika et al. | 604/132 |
| 5,290,238 | 3/1994 | Crass et al. | 604/132 X |

*Primary Examiner*—Joseph A. Kaufman
*Attorney, Agent, or Firm*—Mason, Kolehmainen, Rathburn & Wyss

[57] ABSTRACT

An infusion pump has an outer housing within which is disposed a support mandrel with a bladder secured thereon. The mandrel has a substantially uniform circular cross-section with a central channel extending from an input end to an outlet end that has an enlarged mandrel flange or collar. An infusion tube is inserted through the inlet end, through the central channel and out through the outlet end of the mandrel. A seating tube bonded at a distal end of the infusion tube becomes seated in a tapered seating portion in the central channel. Thereafter the elastomeric bladder is secured on the mandrel. After both the infusion tube and the bladder have been secured to the mandrel, the inlet end of the mandrel is inserted through a bottom opening in the housing until the collar of the mandrel becomes seated in a circular collar projecting from a lower wall of the housing. A check valve is connected to the mandrel by a luer lock fitting through a top opening at the inlet end of the mandrel thereby securing the mandrel in the housing and closing the top and bottom openings. The end of the infusion tube that is extended out through the outlet end of the mandrel channel has a manually actuated tube clamp to regulate the flow of liquid from the bladder through the infusion tube and is connected to an air and particle eliminating filter. Another tube extending from the filter is connected to a flow control regulating device.

16 Claims, 3 Drawing Sheets

INFUSION PUMP

BACKGROUND OF THE INVENTION

1. Field of the Invention

The present invention generally relates to a liquid dispensing apparatus, and, more particularly, to a new and improved compact, ambulatory infusion pump having an elastomeric bladder for dispensing intravenous or other pharmaceutical drugs to a patient.

2. Description of the Prior Art

Some medical patients need to receive intravenous or other pharmaceutical drugs. These patients are not necessarily restricted to bed or confined to a hospital and consequently, infusion devices have been developed by which such drugs can be dispensed while the patient is ambulatory. Typically these infusion devices or pumps have an outer housing with an elastomeric bladder that is mounted therein on an internal stress mandrel disposed within the housing. When the bladder is being filled with a liquid, such as intravenous drugs, the elastic bladder will expand such that a dispensing pressure will be exerted on the liquid within the expanded bladder. As a result, the fluid can be dispensed out from the bladder via an infusion tube or the like connected to or through the mandrel.

Previously designed infusion pumps tend to be somewhat difficult and costly to manufacture and assemble. In some of these infusion pumps, the elastomeric bladders are prestressed either in the axial or radial directions or in both such directions prior to the introduction of fluid into the bladder. The prestressing of the bladder in this fashion tends to provide a more uniform pressure profile for the liquid being dispensed from the infusion pump and enables a higher percentage of the liquid to be dispensed from within the bladder. However, prestressing of the bladder in this manner tends to make assembly of such infusion devices more difficult. In addition, the manufacturing and assembly of previously designed infusion pumps tend to be costly due at least in part to the number of different component parts that need to be separately manufactured and assembled and the difficulty of assembling and the amount of time required to assemble these components.

SUMMARY OF THE INVENTION

Accordingly, objects of the present invention are to provide a new and improved ambulatory infusion pump for dispensing liquid; to provide a new and improved infusion pump for dispensing intravenous or other pharmaceutical drugs to an ambulatory patient; to provide a new and improved infusion pump that is relatively simple to manufacture and assemble; and to provide a new and improved infusion pump that is cost effective to manufacture and assemble.

In accordance with these and many other objects of the present invention, an infusion pump embodying the present invention includes a single piece plastic housing having an opening in both the top and bottom walls. A mandrel is adapted to be inserted through the bottom opening in the housing. The mandrel has a substantially uniform circular cross-section with four shallow channels extending along a portion of the mandrel. A central channel extends from a luer lock input end of the mandrel to an outlet end that has an enlarged mandrel flange or collar. The four shallow channels are in fluid communication with ducts radiating out from the central channel.

Before the mandrel is installed in the pump housing, an infusion tube is inserted through the inlet end of the mandrel, through the central channel and out through the outlet end of the mandrel. A seating tube bonded on a distal end of the infusion tube becomes seated in a tapered seating portion in the central channel thereby securing the infusion tube in the central channel of the mandrel.

After the infusion tube has been secured in the central channel of the mandrel, an elastomeric bladder is slid over the inlet end of the mandrel and positioned on the mandrel such that end portions of the bladder can be secured between raised annular positioning ribs formed on the outer surface of the mandrel in order to seal the bladder at each end thereof. The bladder is positioned on the mandrel so that the shallow channels are within the seal ends of the bladder and is sized so that the bladder is not stretched or prestressed in the radial or axial directions prior to the introduction of fluid into the bladder.

After both the infusion tube and the bladder have been secured to the mandrel, the inlet end of the mandrel is inserted through the bottom opening of the pump housing until the inlet end is positioned in the opening in the top wall of the pump housing and the collar of the mandrel becomes seated in a circular collar or stand projecting from the lower wall of the pump housing. A check valve then is extended through the hole in the top of the housing and is connected to the mandrel by a luer lock fitting at the inlet end of the mandrel. As the check valve is secured to the luer lock fitting, the check valve closes the opening in the top wall of the pump housing and the mandrel collar at the other end of the mandrel is compressed against the bottom of the housing because the mandrel is placed in tension and is thereby secured in place on the pump housing.

The end of the infusion tube that is extended through the mandrel and out through the outlet end of the mandrel channel is connected to a filter that is adapted to eliminate air from the liquid flowing through the tube as well as any particles within the liquid. Another tube extends from the filter to a flow control regulating device that regulates the flow of liquid out of the infusion pump or bladder through the infusion tube. A manually actuated tube clamp is positioned on the infusion tube between the outlet end of the mandrel and the filter to stop the flow of liquid from the bladder through the infusion tube.

In order to fill the bladder with an intravenous or another pharmaceutical drug, a syringe or other drug delivery device is used to furnish liquid through the check valve secured to the inlet end of the mandrel. The liquid being introduced flows through the central channel of the mandrel and the ducts radiating therefrom into the sealed bladder. The bladder will accordingly expand until a desired amount of fluid has been inputted into the bladder. The expansion of the bladder results in the bladder outer wall exerting a dispensing pressure against the fluid that has been inserted into the bladder. The check valve insures that the liquid cannot flow back out through the inlet end of the mandrel and the tube clamp blocks the flow of fluid out from the outlet end of the mandrel through the infusion tube until the tube clamp is opened.

Alternatively, the filter and flow control device could be disposed within the central channel in the mandrel, particularly when an air eliminating filter is not required. When caustic drugs are used in the infusion pump, the mandrel and check valve may additionally be glued or otherwise bonded to the pump housing to insure an air tight seal. In such a case, an air vent would have to be extended through the pump housing or the mandrel collar to allow air to escape out from and to enter into the pump housing.

BRIEF DESCRIPTION OF THE DRAWING

The present invention, together with the above and other objects and advantages, can best be understood from the following detailed description of the embodiment of the invention illustrated in the drawing, wherein.

DETAILED DESCRIPTION OF THE PREFERRED EMBODIMENT

Figure 1:
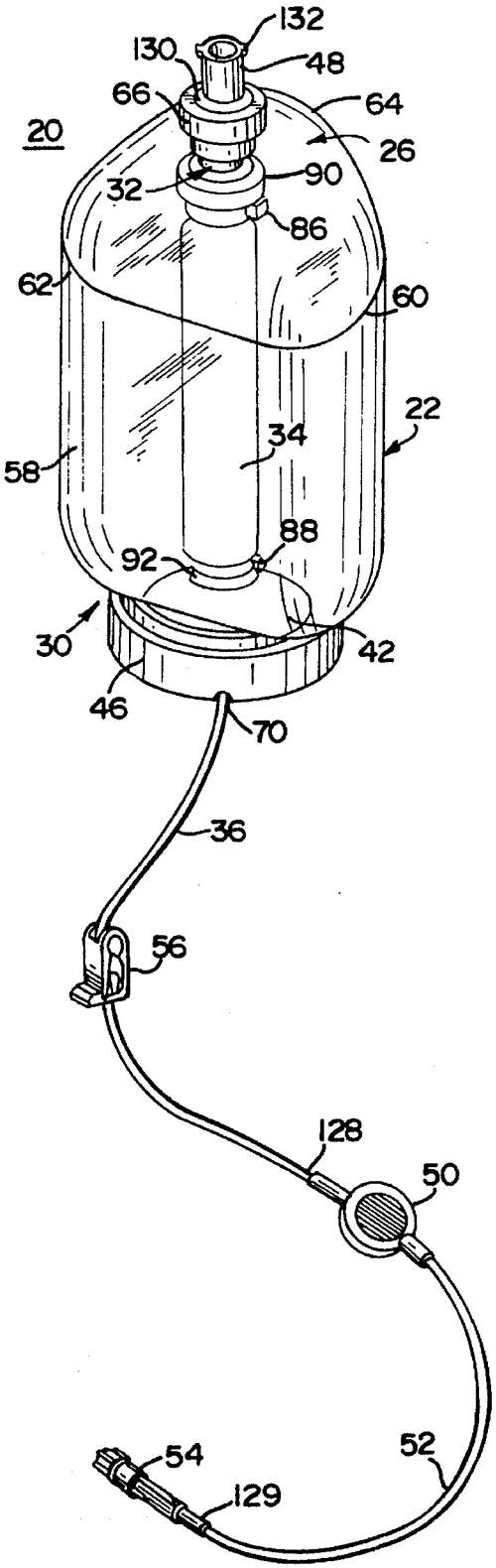
FIG. 1 is a perspective view of an ambulatory infusion pump embodying the present invention.
Figure 2:
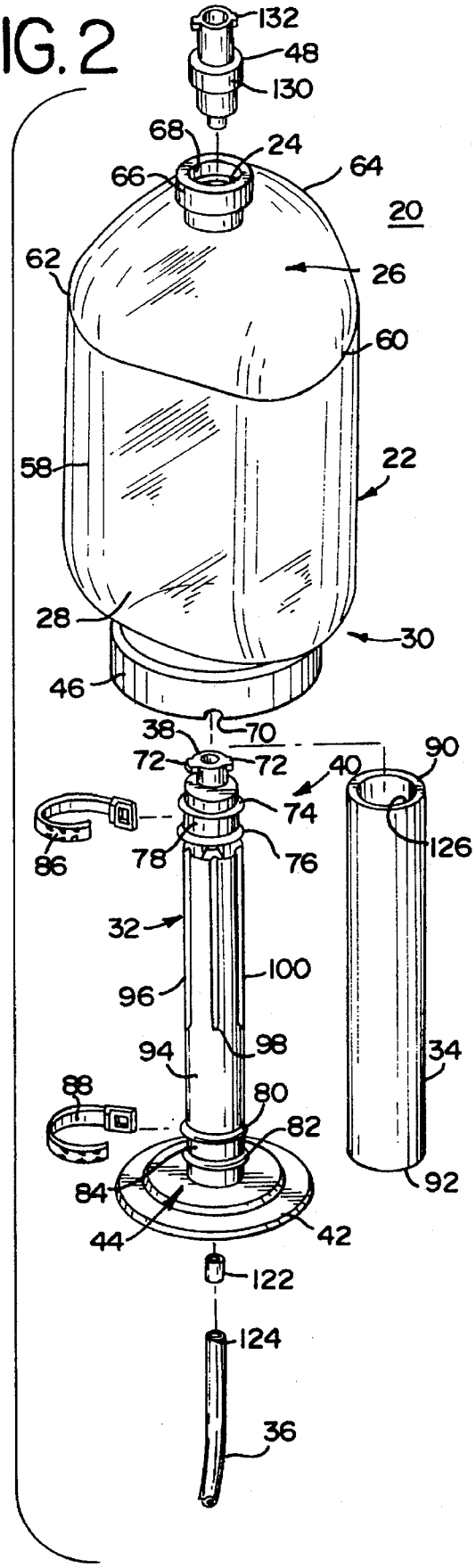
FIG. 2 is an exploded perspective view of the ambulatory infusion pump of FIG. 1.
Figure 3:
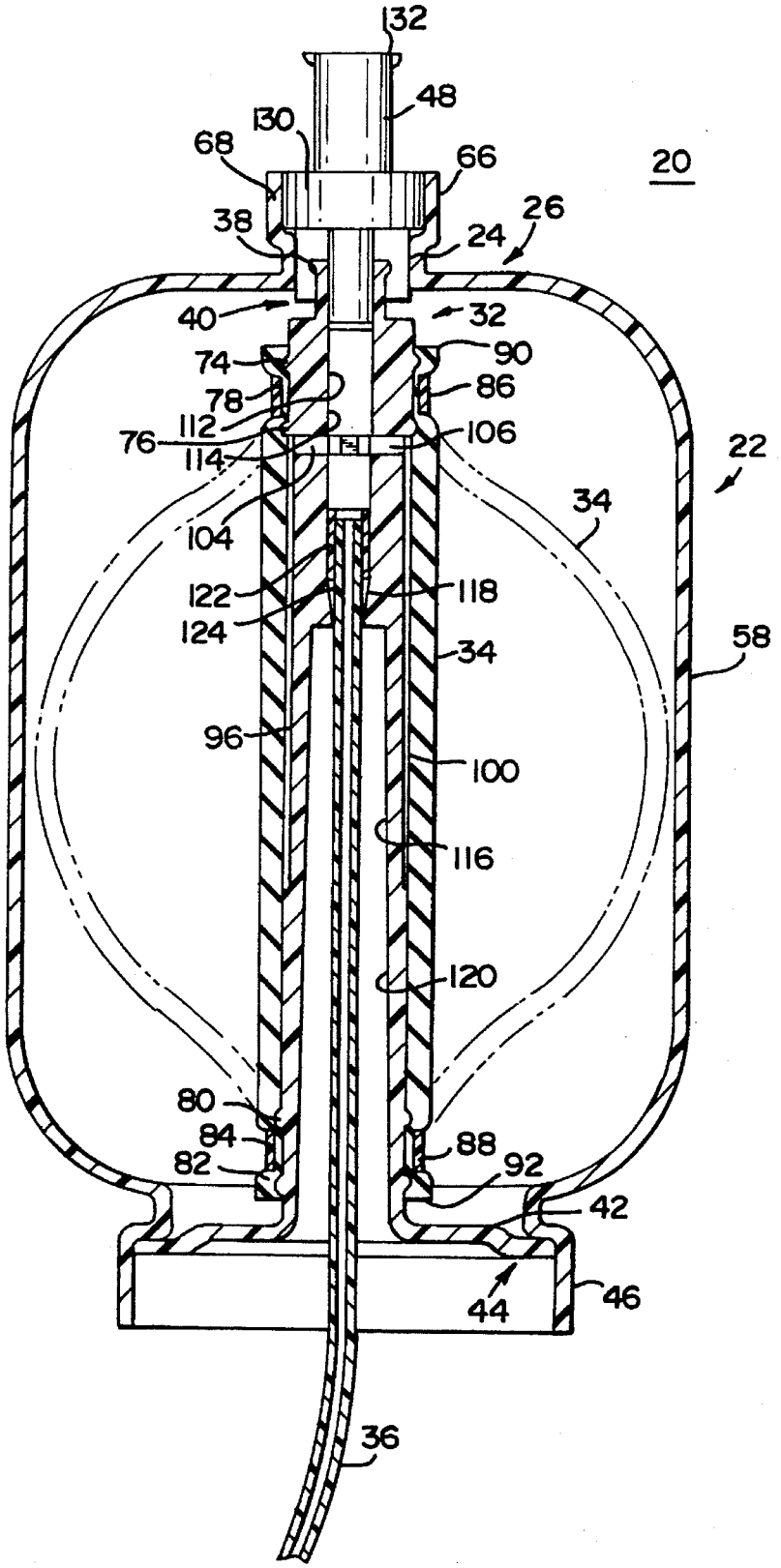
FIG. 3 is a partial cross sectional view of the ambulatory infusion pump of FIG. 1.
Figure 4:
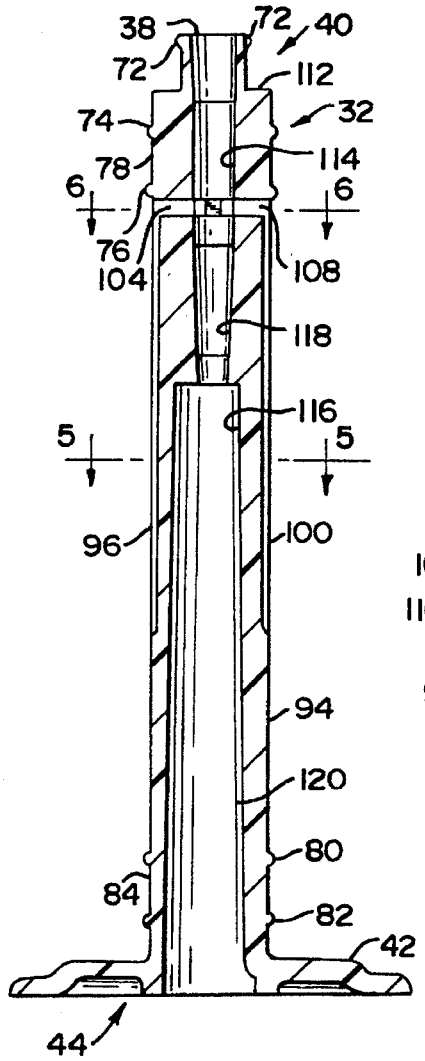
FIG. 4 is a cross sectional view of the mandrel used in the ambulatory infusion pump of FIG. 1.

Referring now more specifically to FIGS. 1–3 of the drawings, therein is disclosed an infusion pump generally designated by the reference numeral 20 and embodying the present invention. The infusion pump 20 includes an outer housing 22 having a relatively small inlet end opening 24 at an inlet end 26 and a larger outlet end opening 28 in an outlet end 30. A mandrel 32 with an elastomeric bladder 34 mounted thereon and an infusion tube 36 extending therefrom is adapted to be inserted through the outlet opening 28 in the housing 22. The mandrel 32 has a luer lock fitting 38 at a mandrel input end 40 that is inserted through the outlet opening 28 until the luer lock fitting 38 is disposed in the inlet opening 24 of the housing 22 and an enlarged mandrel flange or collar 42 at a mandrel output end 44 is disposed in a collar or stand 46 projecting from the outlet end 30 of the housing 22. The mandrel 32 is secured in position in the housing 22 when a check valve 48 is secured to the luer lock fitting 38. The infusion tube 36 extends out from the mandrel output end 30 and is coupled to a filter 50 which is in turn connected via another tube 52 to a flow control device 54. Flow of fluid through the infusion tube 36 is controlled by a manually actuated tube clamp 56 disposed on the infusion tube 36 between the outlet end 44 of the mandrel 32 and the filter 50.

A syringe or other drug delivery device (not shown) can be used to supply an intravenous or another pharmaceutical drug into the infusion pump 20. Such a syringe is inserted into the check valve 48 at the inlet end of the housing 22. The liquid drug flows through the check valve 48 and the mandrel 32 into the bladder 34. The liquid being inserted through the check valve 48 will not flow out through the infusion tube 36 because the tube clamp 56 is closed. As the liquid is forced into the bladder 34, the elastic bladder 34 will expand as shown by the phantom lines in FIG. 3. Once the filling of the bladder 34 is completed, the liquid within the bladder 34 will be retained therein because the check valve 48 allows fluid to flow only into the mandrel 32 and the tube clamp 56 prevents fluid from flowing out through the infusion tube 36. The expansion of the bladder 34 results in a dispensing force being exerted against the liquid within the bladder 34 so that the liquid can be dispensed out through the infusion tube 36 when the tube clamp 56 is released.

Figure 7:
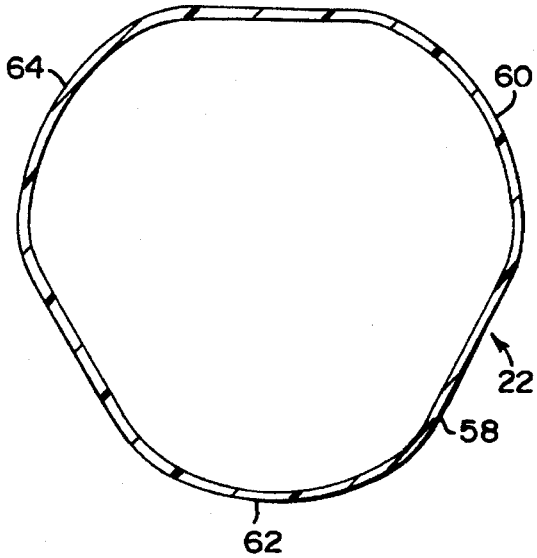
FIG. 7 is a cross sectional view of the outer housing of the ambulatory infusion pump of FIG. 1 disclosing the outer configuration of the housing.
Figure 5:
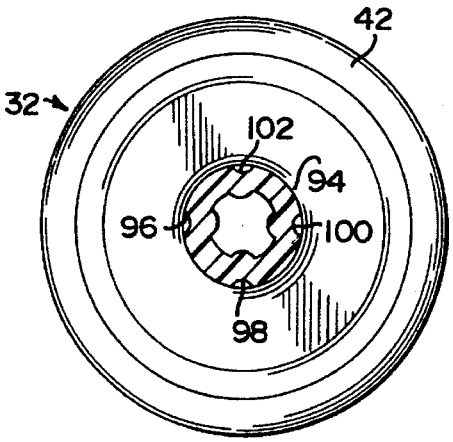
FIG. 5 is a cross sectional view taken along line 5—5 in FIG. 4.

The outer housing 22 has a body portion 58 with a generally triangular shape with relatively large radius rounded corners 60, 62 and 64 (see FIG. 7). This particular shape provides the housing 22 with a generally rounded configuration, but nevertheless the housing 22 will not tend to roll when placed on a flat surface. The housing 22 can be made in a single piece by extruding using a K-Resin plastic or other suitable material and can be transparent or clear so that the inflation and deflation of the bladder 34 can be viewed. However, a portion of the body portion 58 adjacent the inlet end 26 and the outlet end 30 can be smoked or otherwise frosted. The material from which the housing 22 is made needs to be selected so that the housing 22 is sufficiently sturdy to protect the bladder 34 from any outside forces, but at the same time needs to be sufficiently flexible or pliable that a secure fit can be accomplished when the mandrel 32 is secured to the housing 22.

The opening 24 in the inlet end 26 of the housing 22 extends through a small collar 66 that provides a recess 68 into which the check valve 48 can be disposed. The collar or stand 46 at the outlet end 30 of the housing 22 enables the infusion pump 20 to be placed upright on a flat surface. As shown in FIGS. 1–2, the collar 46 has a small notch 70 through which the infusion tube 36 can extend so that the infusion pump 20 can be placed in an upright position on a flat surface even though the infusion tube 36 is extending out from the outlet end 30 of the housing 22.

The mandrel 32 may be made of an acrylic material such as G-20 HIFLO. The inlet end 40 includes the luer lock fitting 38 having luer lock projections 72 that are adapted to mate with threads within the check valve 48. A pair of annular ribs 74 and 76 are formed on the mandrel 32 adjacent the inlet end 38 such that a tie area 78 is formed therebetween. Another pair of annular ribs 80 and 82 are formed adjacent the outlet end 44 of the mandrel 32 such that another tie area 84 is formed therebetween. These tie areas 78 and 84 provide areas in which ties 86 and 88, respectively, can be used to secure the bladder 34 to the mandrel 32 in such a manner that opposite ends 90 and 92 of the bladder 34 are sealed to the mandrel 32.

Figure 6:
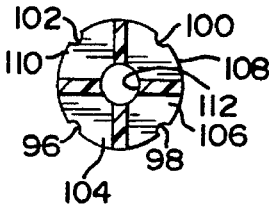
FIG. 6 is a cross sectional view taken along line 6—6 in FIG. 4.

The outer surface 94 of the mandrel 32, which extends between the ribs 76 and 80 and which will be disposed within the bladder 34 after it is secured on the mandrel 32, has a generally circular cross section except for shallow channels 96, 98, 100 and 102 formed axially along a portion of the outer surface 94 adjacent the rib 76. The channels 96, 98, 100 and 102 are in fluid communication with ducts 104, 106, 108 and 110, respectively (see FIG. 6), that extend radially outwardly from a central bore or channel 112 of the mandrel 32. The bore 112 extends through the center of the mandrel 32 from the inlet end 40 to the outlet end 44 and includes an inlet bore portion 114 that extends in the interior of the mandrel 32 from the inlet opening or port 24 to the ducts 104, 106, 108 and 110 thereby providing a fluid passageway for the filling of liquids into the interior of the bladder 34. The circular cross section of the outer surface 94 of the mandrel 32 decreases the residual volume within the bladder 34 in order to decrease any residual liquid that remains within the bladder 34 as it is dispensing liquid. The channels 96, 98, 100 and 102 insure that fluid passageways exist from all parts of the interior of the bladder 34 through the ducts 104, 106, 108 and 110 to the central bore 112 of the mandrel 32.

The central bore 112 also includes an outlet portion 116 that extends from the ducts 104, 106, 108 and 110 to the outlet end 44 of the mandrel 32. The outlet portion 116 has a tapered seating portion 118 that extends from the ducts 104, 106, 108 and 110 to an enlarged outlet section 120. As will be discussed hereinafter, a seating tube 122 bonded on a distal end 124 of the infusion tube 36 becomes seated in the tapered seating portion 118 as a result of which the infusion tube 36 is secured in the central bore 112 of the mandrel 32.

The outlet end 44 of the mandrel 32 includes the enlarged mandrel collar 42. When the mandrel 32 is secured in position in the housing 22, the mandrel collar 42 fits within the collar 46 at the outlet end 30 of the housing 22 and closes the outlet opening 28 in the housing 22.

As is particularly shown in FIGS. 2 and 3 of the drawings, the bladder 34 has a generally right cylindrical outer shape with an interior cavity or bore 126. The bladder 34 is made of a substantially inert tubular elastomeric extrusion. While different elastomeric materials can be used for the bladder 34, the bladder 34 needs to be able to expand to a predetermined volume as liquid is introduced into the inner cavity 126. In addition, the bladder 34 must have an elastic memory such that the bladder 34 will collapse as liquid is dispensed out from the infusion pump 20 to essentially its original, non-expanded size. By having such an elastic memory, substantially all (for example, 95%) of the liquid introduced into the interior cavity 126 of the bladder 34 can be dispensed. The bladder 34 also needs to have a low hysterisis so that the flow rate of liquid out from the interior cavity 126 of the bladder 34 remains essentially constant. In the particular design disclosed in the present application, the inner diameter of the interior cavity 126 and the length of the bladder 34 from the end 90 to the opposite end 92 are made such that the bladder 34 is not prestressed in the radial or axial direction when the bladder 34 is disposed about the mandrel 32 before liquid is introduced into the interior cavity 126. Once the bladder 34 is positioned about the mandrel 32, the ties 86 and 88 can be used to secure the ends 90 and 92 respectively in the tie areas 78 and 84 thereby sealing the opposite ends 90 and 92 of the bladder 32 and providing the sealed interior cavity 126 for the introduction of liquid.

The infusion tube 36 that extends out from the outlet end 30 of the mandrel 32 may be in the form of a standard intravenous supply tubing having an inner diameter that permits the appropriate flow of fluid from the infusion pump 20. The seating tube 122 is secured to the distal end 124 of the infusion tube 36. The seating tube 122 is a relatively short piece of tubing having an inner diameter appropriately the size of the outer diameter of the infusion tube 36 such that the seating tube 122 can be mounted over the end 124 of the infusion tube 36. The seating tube 122 can be bonded to the distal end 124 of the infusion tube 36 by an appropriate solvent, such as cyclohexanone. The filter 50 is secured to another end 128 of the infusion tube 36. The filter 50 is adapted to eliminate any air and/or particles that are contained in the liquid being dispensed from the infusion pump 20. This insures that air within the liquid being dispensed from the infusion pump 20 does not adversely affect the patient receiving the liquid and that particles within the liquid do not clog the flow of the liquid through the flow control device 54.

The flow control device 54 is connected to the filter 50 by the tubing 52 and a strain relief tube 129. The flow control device 54 is adapted to control the flow rate of the liquid being dispensed from the infusion pump 20. In this regard, a reduced inner diameter capillary tube through which the liquid flows is disposed in the strain relief 129 so that the flow rate of the liquid from the flow control device 54 is maintained at a desired level. As previously indicated, the flow of liquid out through the infusion tube 36 can be stopped when the tube clamp 56 is closed and is permitted to flow when the tube clamp 56 is opened so that it no longer clamps the infusion tube 36.

The particular configuration of the components of the infusion pump 20 enable the infusion pump 20 to be readily manufactured and assembled. In assembling the infusion pump 20, the infusion tube 36 needs to be secured to the mandrel 32. In order to secure the infusion tube 36 to the mandrel 32, the seating tube 122 is affixed at the distal end 124 of the infusion tube 36. As previously indicated, the inner diameter of the seating tube 122 is about the same size as the outer diameter of the infusion tube 36 so that the seating tube 122 can be readily slid over the distal end 124 of the infusion tube 36. The seating tube 122 will be secured to the distal end 124 of the infusion tube 36 by applying an appropriate solvent to the outer periphery of the distal end 124 and/or the inner diameter of the seating tube 122 before positioning the seating tube 122 about the distal end 124 of the infusion tube 36.

After the seating tube 122 has been secured to the distal end 124 of the infusion tube 36, the other end 128 of the infusion tube 36 is slid through the inlet bore portion 114 of the central channel 112 adjacent the inlet end 40 of the mandrel 32, through the tapered seating portion 118 of the channel 112, through the enlarged outlet section 120 of the channel 112 and out from the outlet end 44 of the mandrel 32. As the other end 128 is pulled, the seating tube 122 on the distal end 124 of the infusion tube 36 is pulled through the inlet bore 114 and is squeezed fit or seated in the tapered seating portion 118 of the channel 112 as is depicted in FIG. 3 of the drawings. In this regard, the tapered seating portion 118 is made sufficiently large in diameter that the infusion tube 36 will slide through the seating portion 118 of the channel 112 as the infusion tube 36 is being installed in the mandrel 32, but is smaller than the outer diameter of the seating tube 122 such that the seating tube 122 will become lodged in or squeezed fitted in the tapered seating portion 118. When the seating tube 122 becomes so lodged in the tapered seating portion 118, the infusion tube 36 is properly positioned and secured to the mandrel 32 and seals the inlet portion 114 of the central channel 112 from the outlet portion 116. If necessary, a solvent can be applied to the outer surface of the seating tube 122 before it is inserted into the mandrel 32 to insure that the seating tube 122 is adequately affixed in the tapered seating portion 118 of the channel 112.

After the infusion tube 36 has been affixed to the mandrel 32, the clamp 56 is slid over the end 128 of the infusion tube 36 and positioned as illustrated in FIG. 1 and additionally the filter 50 is attached to the end 128 of the infusion tube 36 and the flow control device 54 is connected to the filter 50 via the tube 52 and the strain relief 129. The bladder 34 then is slid over the inlet end 26 of the mandrel 32 so that the end 90 is positioned about the annular ribs 74 and 76 and the end 92 is positioned about the annular ribs 80 and 82. The tie 86 then is secured about the end 90 in the tie area 78 and the tie 88 is secured about the end 92 in the tie area 84.

The ties 86 and 88 are affixed about the ends 90 and 92, respectively, so that a seal is formed between the ends 90 and 92 and the outer surface 94 of the mandrel 32 in the tie areas 78 and 84. As can be seen particularly in FIG. 3, the inner sealed bore 126 of the bladder 34 is in fluid communication with the central channel 112 through the ducts 104, 106, 108 and 110 and the channels 96, 98, 100 and 102.

After both the infusion tube 36 and the bladder 34 have been secured to the mandrel 32, the inlet end 40 of the mandrel 32 can be inserted through the collar 46, the outlet opening 28 in the outlet end 30 of the housing 22 and the interior of the housing 22 until the inlet end 40 becomes positioned in the recess 68 at the inlet end 26 of the housing 22 and the mandrel flange 42 becomes positioned in the collar 46. The check valve 48 then is rotated onto the luer lock fitting 38 such that the luer lock projections 72 threadedly engage threads in the internal portion of the check valve 48. As the check valve 48 is threaded onto the luer lock fitting 38, the mandrel 32 is placed into tension. As a result, an annular collar 130 on the check valve 48 closes the opening 24 at the inlet 26 of the housing 22 and the mandrel flange 42 is drawn within the collar 46 against the outlet end 30 of the housing 22 to thereby close the opening 28 in the outlet end 30 of the housing 22. The infusion tube 36 then can be inserted into the notch 70 in the collar 46.

In order to assure that the check valve 48 will not rotate with respect to the housing 22, the outer surface of the collar 130 and inner surface of the recess 68 can be provided with ribs or the like. In certain cases, as for example when the infusion pump 20 will be used with caustic drugs, it is necessary to provide an airtight seal between the mandrel 32, the housing 22 and the check valve 46. In those cases, a glue can be applied to the mandrel collar 42 and the check valve 48 to insure that such a seal is attained. When such a seal is formed, an air vent probably will have to be provided to allow air to follow into and out of the housing 22 as the bladder 34 is expanded and contracted. This air vent can be insert molded in the housing 22 or the mandrel collar 42.

After the assembly of the infusion pump 20 has been completed, the bladder 34 can be filled with liquid. A syringe or other delivery device is attached to a luer lock fitting 132 on the check valve 48. Liquid is forced through the check valve 48 and the inlet bore portion 114 and the tapered seating portion 118 of the channel 112 and out through the infusion tube 36. The tube clamp 56 is closed during the filling operation of the infusion pump 20 so that after a small amount of liquid fills the infusion tube 36 that extends out from the mandrel 32 to the tube clamp 56, the liquid will flow through the ducts 104, 106, 108, and 110 as well as the corresponding channels 96, 98, 100, and 102 into the interior bore 126 of the bladder 34. The liquid being introduced through the check valve 48 will be introduced with sufficient pressure that the elastic bladder 34 will expand as for example shown by the phantom lines 34 in FIG. 3 of the drawings. Once the bladder 34 has been filled, the supply device will be removed from the check valve 48. Liquid will not flow out through the check valve 48 because the check valve 48 is designed to permit flow of liquid only into the inlet bore portion 114 and not in the opposite direction.

As long as the tube clamp 56 remains closed, the liquid will be retained in the expanded bladder 34. The expansion of the bladder does exert a pressure against the liquid so that the liquid will be under pressure. When the tube clamp 56 is manually opened, the exerted pressure from the expanded bladder 34 will cause liquid to be dispensed out from the interior bore 126 of the bladder 34, through the ducts 104, 106, 108, and 110, the tapered seating portion 118 of the central channel 112 and the infusion tube 36. The liquid being dispensed from the bladder 34 will flow through the infusion tube 36 and into the filter 50 where air and/or particles in the liquid will be purged. The liquid then flows through the tube 52 and the flow control device 54 into a patient.

As previously indicated, the flow control device 54 restricts the flow of liquid out from the infusion pump 20 to a particular desired flow rate. Due to the elastic material from which the bladder 34 is made, the pressure exerted on the liquid within the interior bore 126 of the bladder 34 will be relatively constant as the bladder 34 contracts with the dispensing of the liquid. The channels 96, 98, 100 and 102 formed in the outer surface 94 of the mandrel 32 that are in fluid communication with the ducts 104, 106, 108 and 110 insure that practically all of the liquid within the bladder 34 will be dispensed. If the channels 96, 98, 100 and 102 were not in the outer surface 94 of the mandrel 32 it is possible that a portion of the bladder 34 could become lodged against the outer surface 94 of the mandrel 32 in a manner that a lower portion of the interior cavity 126 in the bladder 34 would no longer be in fluid communication with the ducts 104, 106, 108 and 110 even though some liquid remained in that lower portion of the interior cavity 126.

Figure 8:
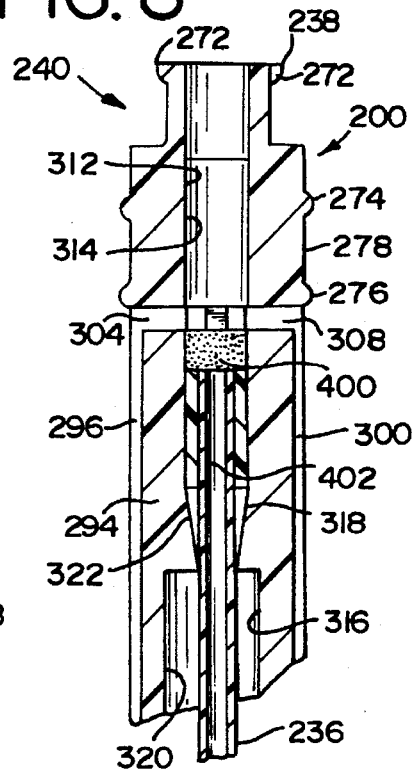
FIG. 8 is a cross sectional view of a portion of an alternate mandrel that can be used in the ambulatory infusion pump of FIG. 1.

It is possible that an in-line air eliminating filter 50 may be unnecessary in certain applications. In such circumstances, an alternate form of the mandrel 32 could be used. One such alternate form of mandrel is illustrated in FIG. 8 of the drawings and is generally designated by the reference numeral 200. Various portions of the mandrel 200 are essentially the same as corresponding portions of the mandrel 32. However, the mandrel 200 is configured slightly different than the mandrel 32 in order that both a filter 400 and an in-line flow control device 402 can be provided within the mandrel 200. The components of the mandrel 200 which are essentially the same as corresponding components in the mandrel 32 and which are specifically referred to herein or shown in FIG. 8 are referenced by the same reference numerals as the corresponding components in the mandrel 32 except that the quantity 200 has been added to the reference numerals for each of the corresponding components in the mandrel 200.

The structure of the mandrel 200 is essentially the same as the structure of the mandrel 32 except for the inclusion of the filter 400 and the flow control device 402 in a tapered seating portion 318. Consequently, reference should be made to the above description of the mandrel 32.

Once a seating tube 322 has been seated within the seating portion 318, the flow control device 402 is inserted through an inlet bore portion 314 of a central channel 312 adjacent an inlet end 240 of the mandrel 200. The flow control device 402 is forced through the inlet bore portion 314 by an appropriate tool until the flow control device 402 becomes lodged or press fitted in the tapered seating portion 318 adjacent the seating tube 322. The flow control device 402 controls the flow rate of liquid out from the infusion pump 20 in the same manner as the flow control device 54. Thereafter, the filter 400 can similarly be inserted through the inlet bore portion 314 until it becomes lodged in the tapered seating portion 318 between ducts such as ducts 304 and 308 and the flow control device 402. The filter 400 also will be press fitted into position in the tapered seating portion 318.

While the invention has been described with reference to details of the illustrated embodiments, these details are not intended to limit the scope of the invention as defined in the appended claims.

What is claimed and desired to be secured by Letters Patent of the United States is:

1. An apparatus for dispensing liquid under pressure comprising:

a housing having a first opening at one end and a second opening at an opposite end thereof;

an elongated support member having a substantially cylindrical outer surface and a central channel extending axially within said support member from an inlet end to an outlet end, said support member having passages extending from said central channel through said outer surface;

a generally cylindrical elastomeric hollow bladder having an internal bore extending therethrough, said bladder being positioned on said support member between said inlet end and said outlet end and being secured thereon such that said internal bore forms a sealed cavity in fluid communication with said passages;

a flexible tube extendable through said inlet end and secured in said central channel so as to extend out from said outlet end of said support member; and securing means adapted to be secured to said inlet end of said support member for securing said support member in said housing.

2. An apparatus for dispensing liquid under pressure as set forth in claim 1 wherein said housing has a generally triangular shape with rounded corners.

3. An apparatus for dispensing liquid under pressure as set forth in claim 1 wherein said housing is made of plastic that is sufficiently pliable that a flange portion on said outlet end of said support member closes said second opening of said housing when said support member is secured to said housing by said securing means.

4. An apparatus for dispensing liquid under pressure as set forth in claim 3 wherein said housing includes a stand collar at said opposite end and said flange portion is adapted to fit within said stand collar when said securing means secures said support member in said housing so that said flange portion closes said second opening.

5. An apparatus for dispensing liquid under pressure as set forth in claim 4 wherein said support member is placed in tension when secured in said housing by said securing means such that said flange portion closes said second opening and said securing means closes said first opening.

6. An apparatus for dispensing liquid under pressure as set forth in claim 4 wherein said stand collar forms a recess area about said opposite end of said housing to permit said tube to exit out from said opposite end of said housing while permitting said opposite end of said housing to stand upright on a support surface.

7. An apparatus for dispensing liquid under pressure as set forth in claim 1 wherein said securing means includes a check valve that permits flow of fluid only into said central channel.

8. An apparatus for dispensing liquid under pressure as set forth in claim 1 wherein said support member includes annular ribs that form tie areas therebetween and including tie means for securing opposite ends of said bladder in said tie areas to thereby seal opposite ends of said bladder to said outer surface of said support member.

9. An apparatus for dispensing liquid under pressure as set forth in claim 1 wherein said central channel in said support member includes a tapered seating portion and said flexible tube has a seating means that is adapted to be seated in said seating portion to secure said tube in said central channel.

10. An apparatus for dispensing liquid under pressure as set forth in claim 9 wherein said tube includes a tube portion and wherein said seating means includes a seating tube secured to one end of said tube portion.

11. An apparatus for dispensing liquid under pressure as set forth in claim 1 wherein said passages include a plurality of ducts extending radially out from said central channel and said outer surface includes a plurality of surface channels circumferentially spaced about said outer surface and extending axially along said outer surface with each of said plurality of surface channels being in fluid communication with one of said plurality of ducts.

12. An apparatus for dispensing liquid under pressure as set forth in claim 1 including a flow control means in said central channel.

13. An apparatus for dispensing liquid under pressure as set forth in claim 1 including a filter means in said central channel.

14. An apparatus for dispensing liquid under pressure as set forth in claim 1 wherein the inner diameter of said bladder is of sufficient size that said bladder can be slid onto said support member without being stressed in the radial or axial direction.

15. An apparatus for dispensing liquid under pressure comprising:

a housing having a first opening at one end and a second opening at an opposite end thereof, said housing being made of a relatively pliable plastic;

an elongated support member extending from an inlet end to an outlet end, having a substantially cylindrical outer surface and having a central channel therethrough, said support member having passages extending from said central channel through said outer surface and having a flange portion on said outlet end;

a generally cylindrical elastomeric hollow bladder having art internal bore extending therethrough, said bladder being positioned on said support member between said inlet end and said outlet end and being secured thereon such that said internal bore forms a sealed cavity in fluid communication with said passages;

a tube means secured in said central channel so as to extend out from said outlet end of said support member; and securing means adapted to be secured to said inlet end of said support member for securing said support member in said housing such that said flange portion is pulled against said housing so as to close said second opening of said housing when said support member is secured to said housing by said securing means.

16. An apparatus for dispensing liquid under pressure as set forth in claim 15 wherein said support member is placed in tension as it is being secured to said housing so that said flange portion is pulled against said pliable housing to close said second opening of said housing.

* * * * *